US006515568B1

(12) United States Patent
Maki et al.

(10) Patent No.: US 6,515,568 B1
(45) Date of Patent: Feb. 4, 2003

(54) MULTILAYER COMPONENT HAVING INDUCTIVE IMPEDANCE

(75) Inventors: Hideya Maki, Tokyo (JP); Kenichi Hoshi, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/630,960

(22) Filed: Aug. 2, 2000

(30) Foreign Application Priority Data

Aug. 3, 1999 (JP) ..... 11-219591

(51) Int. Cl.[7] ..... H01F 5/00
(52) U.S. Cl. ..... 336/200; 336/223; 336/232
(58) Field of Search ..... 336/83, 200, 232, 336/223

(56) References Cited

U.S. PATENT DOCUMENTS 5,239,744 A * 8/1993 Fleming et al. ..... 29/602.1
6,045,747 A * 4/2000 Holm ..... 264/618

FOREIGN PATENT DOCUMENTS

| | | |
|---|---|---|
| JP | 55-91103 | 7/1980 |
| JP | 57-55918 | 9/1980 |
| JP | 56-155516 | 12/1981 |
| JP | 56-157011 | 12/1981 |
| JP | 57-173918 | 10/1982 |
| JP | 6-310333 | 11/1994 |

* cited by examiner

*Primary Examiner*—Anh T. Mai
(74) *Attorney, Agent, or Firm*—Lowe Hauptman Gilman & Berner, LLP

(57) ABSTRACT

A laminate includes a plurality of first magnetic substances having a high magnetic permeability, and a plurality of second magnetic substances having a low magnetic permeability or non-magnetic substances. The second magnetic substances are located so that the inductance element in each of the first magnetic substances causes magnetic saturation in response to direct currents of substantially the same magnitude flowing therein.

9 Claims, 4 Drawing Sheets

MULTILAYER COMPONENT HAVING INDUCTIVE IMPEDANCE

BACKGROUND OF THE INVENTION

The present invention relates to a multilayer component having an inductive impedance.

Conventional multilayer components having inductive impedance include structures formed by applying an Ag-based conductive paste for internal electrodes onto magnetic sheets consisting, for example, of an Ni—Zn—Cu ferrite material in a predetermined pattern, and laminating these magnetic sheets. Internal electrodes formed in adjacent magnetic sheets are connected to each other through via holes, thereby forming a coil in the laminate. On both ends of the laminate are also formed external electrodes connected to the internal electrodes.

A relatively large direct current must be passed through a device such as a choke coil or the like of a switching circuit. In conventional multilayer components having inductive impedance, however, a small direct current causes magnetic saturation to occur in a magnetic substance, thereby lowering the inductance values rapidly. Conventional multilayer components having inductive impedance are not suitable for applications that are required to pass a large direct current.

BRIEF SUMMARY OF THE INVENTION

It is the object of the present invention to provide a multilayer inductor having characteristics that are only slightly degraded by magnetic saturation.

To attain this object, the present invention proposes a multilayer component having an inductive impedance comprising a laminate formed by laminating conductors that form a coil and insulators, in which the inductors are mutually connected so as to form a coil that has an axis in the laminating direction of the conductors; the laminate comprises a plurality of first insulators including a magnetic substance having a high magnetic permeability, and at least one second insulator that is located on the inner layer of the laminate and includes a magnetic substance having low magnetic permeability or a non-magnetic substance. The second insulator is located in the laminate in a manner that the inductor elements in regions divided by the second insulator in the laminating direction produce magnetic saturation caused by direct currents of substantially the same magnitude.

According to the present invention, since at least one second insulator that includes a magnetic substance of a low permeability or a non-magnetic substance is located on the inner layer of the laminate, a closed magnetic path is formed in each region divided by the second insulator(s). Although one large closed magnetic path is formed in the entire laminate in conventional multilayer inductors, magnetic fluxes from the divided regions are not combined or are significantly weakly combined in the multilayer component according to the present invention. A small closed magnetic path is formed in each region. Since the number of turns of the coil is about (1/number divided regions) of the total number of turns in each region divided by the second insulator(s), the magnetic field intensity in each region is also about (the square of 1/number of divided regions). Hence, the direct current value that causes magnetic saturation to occur can be increased compared with conventional multilayer inductors.

Also, since the inductance element in each region divided by the second insulator(s) causes magnetic saturation to occur in response to substantially the same direct current value, the multilayer inductor according to the present invention has a direct-current characteristic curve similar to the characteristic curve of one ordinary inductance element.

The other objects, constitution, and effect of the present invention will be described in detail below.

DETAILED DESCRIPTION OF THE DRAWING

Figure 1:
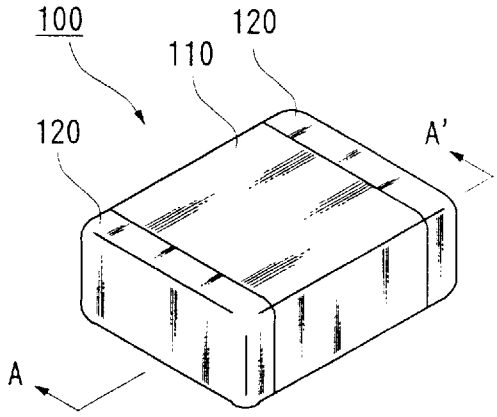
FIG. 1 is a perspective view of a multilayer inductor according to a first embodiment of the present invention.
Figure 2:
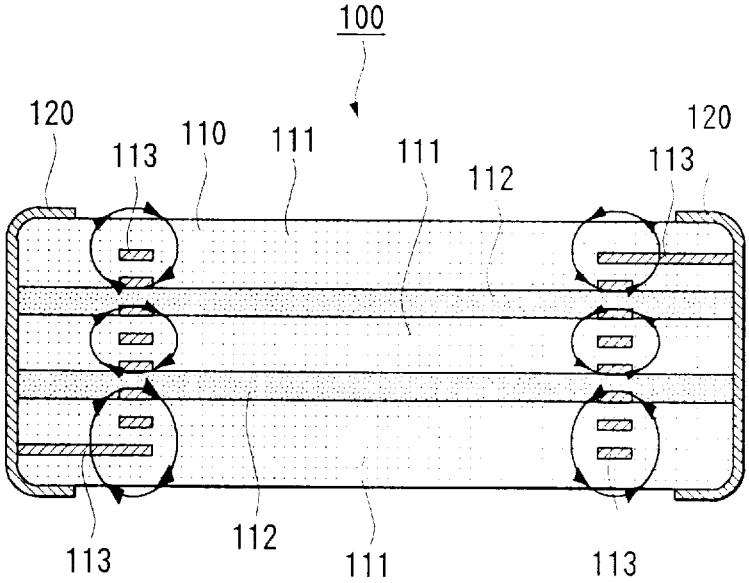
FIG. 2 is a sectional view of a multilayer inductor according to the first embodiment of the present invention taken along the A–A' line in FIG. 1.
Figure 3:
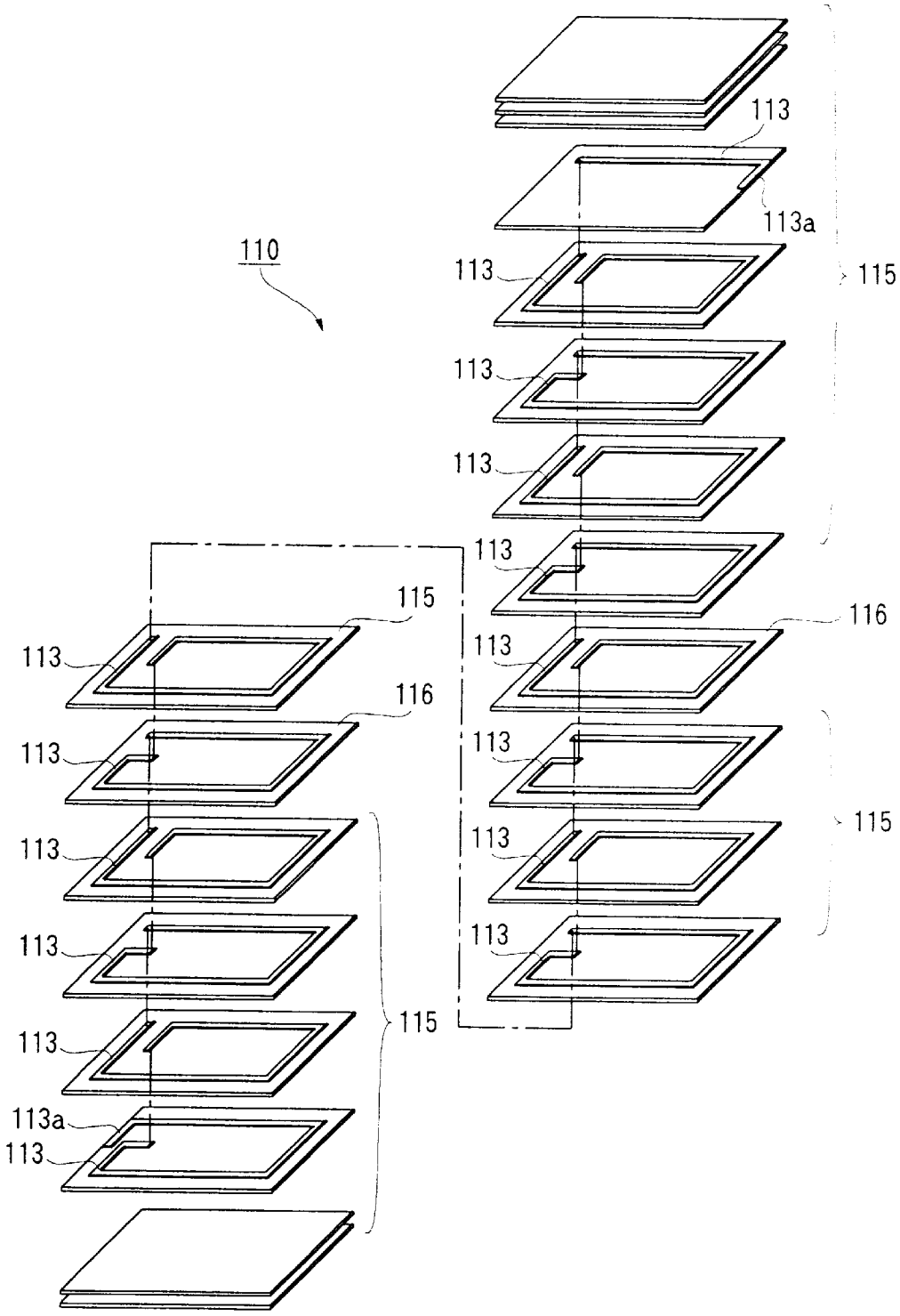
FIG. 3 is an exploded perspective view of a laminate according to the first embodiment of the present invention.

A multilayer inductor according to a first embodiment of the present invention is described by referring to FIGS. 1 to 3. FIG. 1 is a perspective view of a multilayer inductor according to the first embodiment of the present invention, FIG. 2 is a sectional view of a multilayer inductor according to the first embodiment of the present invention taken along the A–A' line in FIG. 1, and FIG. 3 is an exploded perspective view of the laminate according to the first embodiment of the present invention. For the convenience of description, the number of turns of the coil and the like are different in FIGS. 2 and 3.

As FIG. 1 shows, a multilayer inductor 100 comprises a substantially rectangular parallelpiped laminate 110 including a magnetic or non-magnetic insulating material, and a pair of external electrodes 120 formed on the both ends of the laminate 110 in the longitudinal direction.

As is shown in FIG. 2, the laminate 110 has a structure formed by laminating three ferromagnetic layers 111, each consisting of an Ni—Zn—Cu ferrite material and having a high permeability, with two non-ferromagnetic layers 112 consisting of an Ni—Zn—Cu ferrite material and having a permeability smaller than the permeability of the ferromagnetic layer 111. The non-ferromagnetic layers 112 are interposed between layers 111 so that opposite faces of each of layers 112 abut top and bottom faces (as illustrated) of the pair of layers next to each of layers 112.

The permeability of the non-ferromagnetic layer 112 is preferably ⅓ or less, more preferably 1/10 or less, of the permeability of the ferromagnetic layer 111. The reason is that if the permeability is ⅓ or less, the difference in magnetic field intensity becomes 10 times or more, providing layers 111 have at least twice as many turns as layers 112. This relation between the permeabilities of layers 111 and 112 inhibits combining the magnetic fields of layers 111.

It is preferable that the difference in coefficients of linear thermal expansion between the ferromagnetic layers 111 and the non-ferromagnetic layers 112 be small. If there is a large difference of the coefficients of linear thermal expansion between them, cracks or warps may occur in the laminate 110 when the multilayer inductor is packaged. Specifically, a preferable difference of coefficient of linear expansion between layers 111 and 112 is $2\times10^{-7}/°$ C. or smaller.

Furthermore, although the ferromagnetic layers 111 and the non-ferromagnetic layers 112 may get out of alignment with each other on the sides of the laminate 110 because each layer has a composition different from the other, it is preferable that the distance by which the layers get out of alignment be 30 $\mu$m or less. This is because the yield when the external electrodes 120 are formed is decreased.

The thickness of each of the non-ferromagnetic layers 112 is preferably 5 to 100 $\mu$m, more preferably 10 to 50 $\mu$m. A thickness of less than 5 $\mu$m is not preferable, because combining becomes unstable, resulting in variations in electrical properties. Also a thickness of more than 100 $\mu$m is not suitable for down sizing. The multilayer inductor of this embodiment has a thickness of about 1.2 mm in the laminating direction.

Also as FIG. 2 shows, internal electrodes 113, which are conductors that form coils, are embedded in the laminate 110. The axial direction of the coils formed by the internal electrodes 113, that is the flux forming direction in the coils, is the laminating direction of the laminate 110 (the vertical direction of FIG. 2). One end of each coil formed by the internal electrodes 113 is drawn to one end surface of the laminate 110, and the other end is drawn to the other end surface of the laminate 110. The internal electrodes 113 drawn to the end surfaces of the laminate 110 are connected to the external electrodes 120. The internal electrodes 113 and the external electrodes 120 are composed of Ag or an Ag-based metal material.

The detailed structure of the laminate 110 is described by referring to FIG. 3. As FIG. 3 shows, the laminate 110 has a structure including a plurality of laminated insulated ferrite sheets. That is, in the laminate 110, a number of ferrite sheets 115 that have a high permeability, and plural (two in FIG. 3) ferrite sheets 116 that have a lower permeability than that of the ferrite sheets 115 are integrally laminated. The top, i.e., top eight, ferrite sheets 115 form the above-described first ferromagnetic layer 111. The upper ferrite sheet 116 forms the first non-ferromagnetic layer 112, the middle, i.e., intermediate four, ferrite sheets 115 form the second above-described ferromagnetic layer 111, the lower ferrite sheet 116 forms the second non-ferromagnetic layer 112, and the bottom, i.e., bottom six, ferrite sheets 115 form the third ferromagnetic layer 111.

In the top, intermediate and bottom ferrite sheets 115, the internal electrodes 113 of a predetermined pattern are formed, except on the several outer sheets (three upper and two lower sheets in FIG. 3) of the laminate 110. The internal electrodes 113 are also formed in both of ferrite sheets 116. The end of the internal electrode 113 formed in each sheet is connected to the internal electrodes 113 in the adjacent sheets through via holes (not shown) so that the entire laminate 110 forms a coil. Also, the ends of the internal electrodes 113 corresponding to the start and end of the coil winding are connected to the outgoing parts 113*a* formed on the edges of the sheets.

The ferrite sheets 116 are located in the inner layers of the laminate 110. Specifically, each of the ferrite sheets 116 is located in each region of the laminate 110 divided by the ferrite sheets 116 in the laminating direction, that is, in each ferromagnetic layer 111, where the inductor element in the region causes magnetic saturation to occur in response to substantially the same magnitude of direct current. Since the non-ferromagnetic layer 112 formed by the ferrite sheets 116 has a lower permeability than that of the ferromagnetic layer 111, few paths through the non-ferromagnetic layer 112 are formed. As a result, magnetic paths that pass through the ferromagnetic layer 111 or the external space of the laminate 110 are mainly formed in the laminate 110, as shown by solid arrows in FIG. 2. Thus, the magnetic field generated in each ferromagnetic layer 111 is not combined with the magnetic field of the other ferromagnetic layers 111. Since the number of turns of the coil in each of layers 111 is about equal to the total number of turns in coil 110 divided by the number of layers 111, and the intensity of magnetic field generated by the coil 110 is proportional to the square of the number of turns in the coil, the intensity of magnetic field generated in coil 110 is smaller than the magnetic field intensity of an ordinary multilayer inductor that does not include non-ferromagnetic layer 112. Therefore, each inductance element in each ferromagnetic layer 111 has a larger direct current value that causes magnetic saturation to occur than conventional multilayer inductors. By locating the second ferrite sheets 112 in a manner that causes the direct current value that causes magnetic saturation to be substantially the same throughout each of the regions 111, a multilayer inductor that has the same direct-current characteristics as a whole can be obtained.

Next, a method of manufacturing multilayer inductor 100 is described. The case where a large number of multilayer inductors 100 are collectively manufactured will be described.

First, ferrite sheets 111 and 112 are formed. Ethyl cellulose and terpineol are added to calcinated and ground fine powder of ferrite consisting of $FeO_2$, CuO, ZnO, and NiO. The resulting mixture is kneaded to form a ferrite paste. This ferrite paste is formed into ferrite sheets 111 using the doctor-blade method or the like. Ferrite sheets 112 are formed from the same materials, by changing the mixing ratio so sheets 112 have a lower magnetic permeability than the permeability of the ferrite sheets 111. The method for forming the ferrite sheets 112 is the same as for the ferrite sheets 111.

Then, via holes are formed in ferrite sheets 111 and 112 by means such as punching using a die or laser processing. A conductive paste is then printed on ferrite sheets 111 and 112 to form predetermined patterns. For example, an Ag-based metal paste is used as the conductive paste.

Next, ferrite sheets 111 and 112 are laminated and compressed in a manner that the conductive paste between the sheets are connected through the via holes to form a sheet laminate. The ferrite sheets 111 and 112 are laminated in a predetermined order as described above referring to FIG. 3.

Thereafter, the sheet laminate is cut so as to have the unit dimensions to obtain a laminate 110. This cut laminate is then heated in air at about 500° C. for 1 hour to remove the binder component. This laminate is sintered by further heating in air at about 800 to 900° C. for 2 hours.

Next, a conductive paste is applied to the both end surfaces of the laminate 110 by methods such as dipping. The laminate 110 is further sintered in air at about 600° C. for 1 hour to form external electrodes 120. A conductive paste of the same composition as in the formation of internal electrodes is used to form electrodes 120. Finally, the external electrodes 120 are plated to obtain a multilayer inductor 100.

In such a multilayer inductor 100, since at least one non-ferromagnetic layer 112 comprising a low permeability ferrite sheet 116 is formed as an inner layer of the laminate 110, a closed magnetic path is formed in each ferromagnetic layer 111 divided by the non-ferromagnetic layer 112. That is, although one large closed magnetic path is formed in the entire laminate in conventional multilayer inductors, magnetic fluxes are not or are only significantly weakly combined between ferromagnetic layer 111 in the multilayer inductor 100, and a small closed magnetic path is formed in each region. Since the number of turns of coil 110 is about (1/number of divisions) of the total number of turns in each region divided by the non-ferromagnetic layer 112, the magnetic field intensity of each region formed by layers 111 is also about the square of 1/number of divisions, whereby the direct current value that causes magnetic saturation to occur can be increased compared with conventional multilayer inductors.

Also, since the inductance element in each region 111 divided by the non-ferromagnetic layer 112 causes magnetic saturation to occur in response to substantially the same magnitude of direct currents, the multilayer inductor 100 has the same characteristic curve as the direct-current characteristics of one ordinary inductance element.

Figure 4:
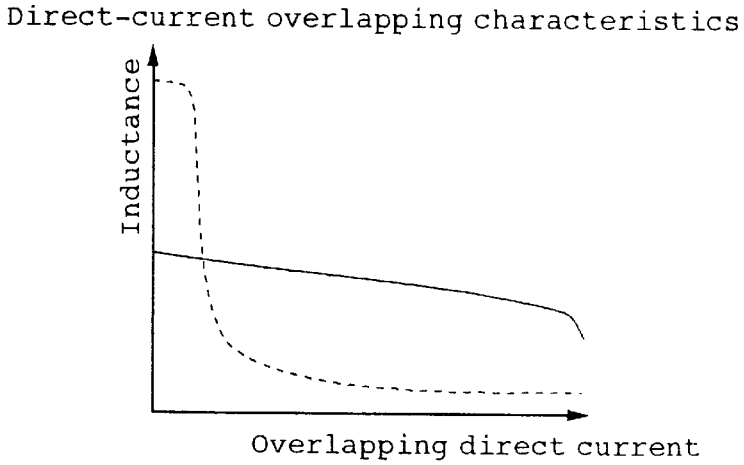
FIG. 4 is a graph showing direct-current characteristics of a multilayer inductor according to the first embodiment of the present invention.

The direct-current characteristic of the multilayer inductor 100 according to this embodiment is described by referring to the graph of FIG. 4. FIG. 4 is a graph showing the direct-current characteristics of a multilayer inductor 100, wherein the abscissa indicates direct currents, and the ordinate indicates the inductance of the inductor. Also in FIG. 4, the solid line represents the characteristics of the multilayer inductor 100 according to this embodiment, and the dotted line represents the characteristics of a conventional multilayer inductor for comparison.

As can be seen from FIG. 4, the inductance of multilayer inductor 100 does not have a large negative going sudden change as the current in the inductor increases slightly. In the prior art, such a sudden change occurred because the magnetic material saturated in response to a low DC current. Because layers 212 substantially decouple the magnetic fluxes of each of layers 211 from each other, as indicated by the illustration of substantially circular flux paths in FIG. 2, the total magnetic flux in each of layers 211 is reduced and magnetic saturation does not occur for the DC currents that normally flow in the coil formed by conductors 113. Therefore, the multilayer inductor 100 is suitable for applications in which a large current is passed, such as a choke coil in a switching power circuit. Since magnetic field intensity in each region, i.e., layer 111, divided by each of the non-ferromagnetic layers 112 is lower than the magnetic field intensity of conventional multilayer inductors, the inductance of the multilayer inductor 100 is small for small DC currents as is seen in FIG. 4. However, a multilayer inductor that has desired inductance as well as optional direct-current characteristics up to a desired current value can be obtained by adjusting the number of divisions of the laminate or the pattern of the internal electrodes.

Figure 5:
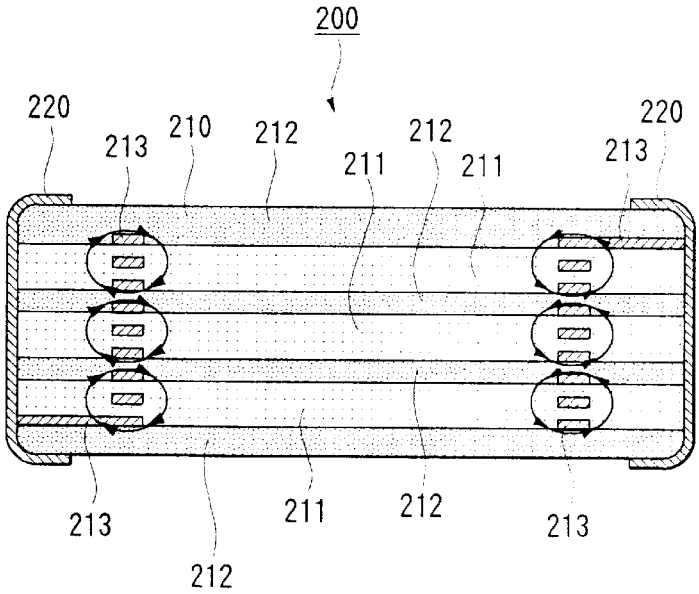
FIG. 5 is sectional view of a multilayer inductor according to a second embodiment of the present invention.
Figure 6:
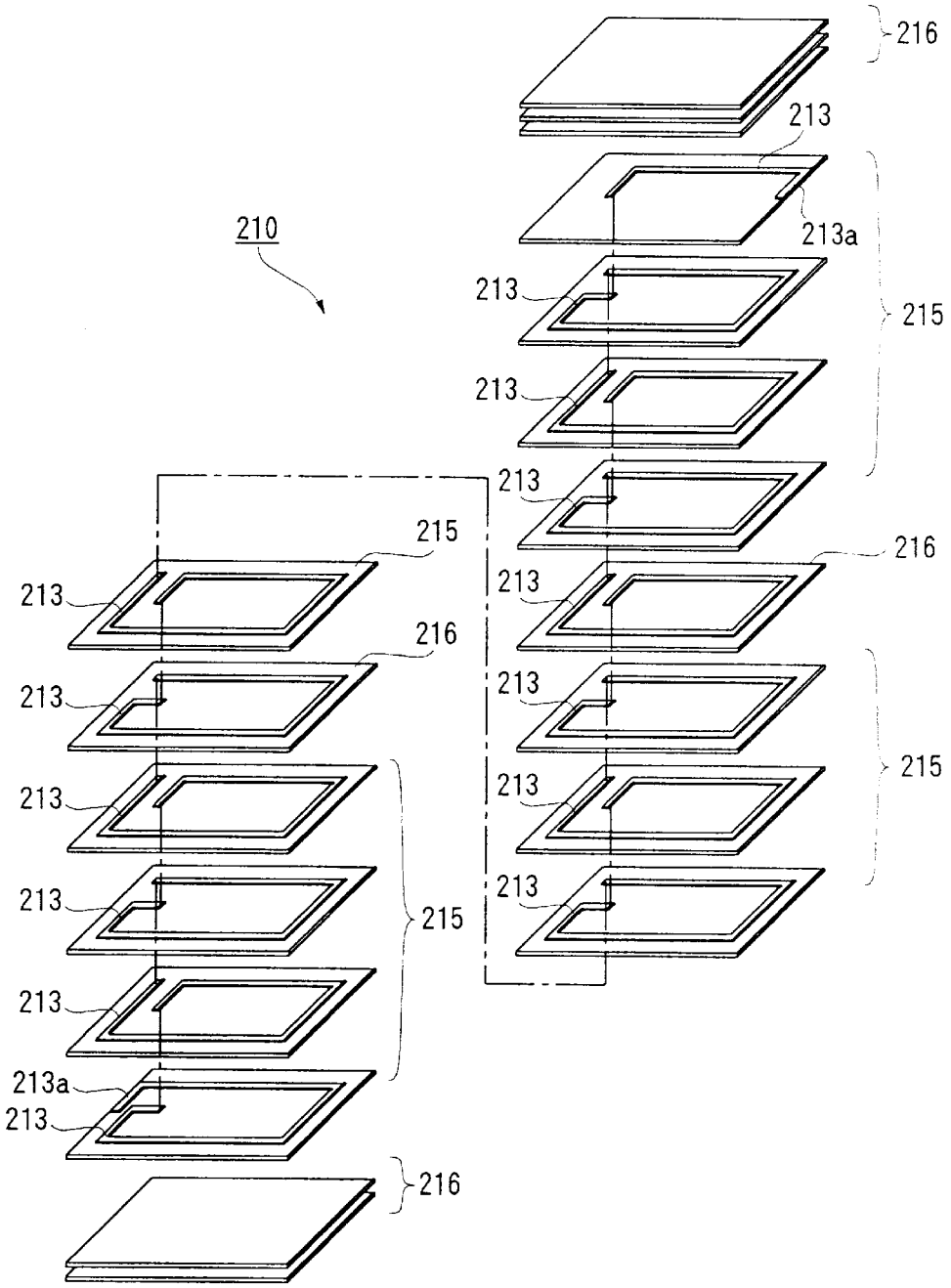
FIG. 6 is an exploded perspective view of a laminate according to the second embodiment of the present invention.

Multilayer inductor 200, a second embodiment of the present invention, is described below by referring to FIGS. 5 and 6. FIG. 5 is a sectional view of a multilayer inductor according to the second embodiment, and FIG. 6 is an exploded perspective view of the laminate according to the second embodiment. For the convenience of description, the number of turns of the coil and the like are different in FIGS. 5 and 6.

The multilayer inductor 200 differs from the multilayer inductor 100 because laminated structure of laminate 210 of inductor 200 differs from laminate 110 of inductor 100. Since other constitutions are the same as in the first embodiment, only the difference is described here.

As shown in FIG. 5, the laminate 210 includes three ferromagnetic layers 211, each consisting of an Ni—Zn—Cu ferrite material and having a high permeability. Adjacent layers 211 are spaced from each other by non-ferromagnetic layers 212 consisting of an Ni—Zn—Cu ferrite material and having a permeability smaller than the permeability of the ferromagnetic layer 211. The non-ferromagnetic layers 212 are formed in the inner layers of the laminate 210 as well as on the outer layers. Each of ferromagnetic layers 211 formed in the inner layer of the laminate 210 has substantially the same thickness.

The laminate 210, as FIG. 6 shows, includes four ferrite sheets 215 that have a high permeability. Sheets 215 are laminated to form a first top layer 211; four ferrite sheets 215 having a high magnetic permeability form a second intermediate, high permeability layer 211; and four ferrite sheets 215 form a third high permeability bottom layer 211. Low magnetic permeability upper sheet 216 forming non-ferromagnetic layer 212 separates top high permeability layer 211 from intermediate high permeability layer 211, and low permeability lower sheet 216, forming another non-ferromagnetic layer 212, separates intermediate high permeability layer 211 from bottom high permeability layer 211. Plural outer sheets (in FIG. 6, three upper layers and two lower layers) of the laminate 210 are composed of low permeability ferrite sheets 116. Also, as FIG. 6 shows, the same number (four in FIG. 6) of the ferrite sheets 215 sandwiched by the ferrite sheets 216 are laminated, whereby each ferromagnetic layer 211 formed by the ferrite sheets 215 has the same thickness.

Since multilayer inductor 200 has non-ferromagnetic layers 212 formed of the ferrite sheets 216 on the outer layers of the laminate 210, and the ferromagnetic layers 211 which are divided by the non-ferromagnetic layers 212 have substantially the same thickness, the magnetic field intensity generated in each ferromagnetic layer 211 can be equalized, in which case the inductance element in each of ferromagnetic layers 211 causes magnetic saturation to occur in response to substantially the same magnitude of direct current. Other advantages, effects, and manufacturing processes are the same as in the first embodiment.

It should be noted that the embodiments described herein are only used as examples, and do not limit the present invention. The scope of the present invention is shown in the attached claims, and all the variations included in the meaning of these claims are included in the scope of the present invention.

For example, in the first and second embodiments, although the non-ferromagnetic layer formed in the inner layer of the laminate is made of magnetic substance that has a lower permeability than the permeability of the ferromagnetic layer, this does not limit the present invention. For example, a non-magnetic substance ($\mu$=1) consisting of Zn—Cu ferrite material can be used. In this case, a diffusion layer from the ferromagnetic layer is formed on the boundary between the non-ferromagnetic layer and the ferromagnetic layer. If the diffusion layer is defined as a layer that has an Ni content of the magnetic layer is 10% or more, it is preferable to form this diffusion layer to have a thickness of 5 $\mu$m or less. This is because the characteristics of the magnetic material may vary due to diffusion, and desired electrical properties may not be obtained.

Furthermore, although two non-ferromagnetic layers are formed in the inner layers of the laminate in the first and second embodiments, that is, although the ferromagnetic region in the laminate is divided into three regions by laminating two non-ferromagnetic ferrite sheets in the inner layers, the present invention is not limited to this. That is, the ferromagnetic region in the laminate can be divided into two regions by forming one non-ferromagnetic layer in the inner layer of the laminate, in other words, by laminating one non-ferromagnetic ferrite sheet in the inner layer. Furthermore, the ferromagnetic region in the laminate can be divided into four or more regions by forming three or more non-ferromagnetic layers in the inner layers of the laminate, in other words, by laminating three or more ferrite sheets similar to sheets 116 or 216 in the inner layers.

Moreover, in the first and second embodiments, although the multilayer inductor has one coil as an example, this does not limit the present invention. For example, the present invention can be a multilayer inductor array, a laminated transformer, or a laminated common-mode choke coil that has a plurality of coils. Furthermore, the present invention can be a laminated liquid-crystal composite part, a laminated filter, and the like that has elements other than the inductor (e.g. capacitor) in a laminate.

Furthermore, in the first and second embodiments, although a choke coil in a power circuit is shown as an example of useful applications of the multilayer inductor, the present invention is not limited to it. The multilayer inductor according to the present invention is also useful in other electronic circuits (e.g. signal-related circuits).

What is claimed is:

1. A multilayer component having an inductive impedance comprising a laminate including laminated sheets including conductors that form a coil and insulators, wherein:

said conductors are mutually connected so as to form the coil, the coil having an axis in a laminating direction of the insulators;

said laminate comprising a plurality of first insulators including a magnetic substance of high permeability, and at least one second insulator that is located on an inner layer of the laminate and includes a magnetic substance of low permeability or a non-magnetic substance; and said second insulator being located in the laminate in a manner that inductor elements in regions divided by said second insulator in the laminating direction produce magnetic saturation caused by direct currents of substantially the same magnitude.

2. The multilayer inductor according to claim 1, wherein said laminate has an outer layer formed by said second insulator and comprises the first insulator in each region divided by the second insulator in the laminating direct has the same thickness.

3. The multilayer component according to claim 1, wherein the inductor element in the first insulator in a region of the coil divided by said second insulator in the laminating direction has the same number of turns of the coil as the inductor element in other regions of the coil.

4. A multilayer laminated component having an inductive impedance comprising a first plurality of laminated insulating layers carrying electrical conductors, a second plurality of laminated insulating layers carrying electrical conductors, and a layer arrangement dividing the first and second plurality of layers from each other, the first and second plurality of laminated insulating layers having substantially the same magnetic saturation characteristics such that magnetic saturation occurs in the first plurality of layers in response to a first DC current value flowing in the electrical conductors carried thereby and magnetic flux saturation occurs in the second plurality of layers in response to the first DC current value flowing in the electrical conductors carried thereby, the layer arrangement being arranged for decoupling at least some of the magnetic flux in the first plurality of laminated insulating layers from the magnetic flux in the second plurality of laminated insulated layer and vice versa.

5. The component of claim 4 wherein the conductors of the first and second plurality of layers are connected to each other to form an inductor.

6. The component of claim 4 further including a first additional layer abutting a first face of the first plurality of layers opposite from a second face of the first plurality of layers abutting the layer arrangement, the additional layer being arranged for confining magnetic flux originating in the first plurality of layers substantially to the first plurality of layers.

7. The component of claim 6 further including a second additional layer abutting a second face of the second plurality of layers opposite from a second face of the second plurality of layers abutting the layer arrangement, the additional layer being arranged for confining magnetic flux originating in the second plurality of layers substantially to the second plurality of layers.

8. The component of claim 4 wherein the conductors of the first and second plurality of laminated layers respectively form first and second coil segments having plural turns, the number of turns of the first and second plurality of laminated layers being the same.

9. The component of claim 4 wherein the thicknesses of the first and second plurality of laminated layers are substantially the same.

* * * * *